United States Patent [19]

Colling et al.

[11] 4,052,044

[45] Oct. 4, 1977

[54] METHOD OF AND APPARATUS FOR THE DECRUSTING OF METALLURGICAL LANCES

[75] Inventors: Joseph Colling, Luxembourg; Carlo Heintz; Alfred Unbekand, both of Kayl, all of Luxembourg

[73] Assignee: ARBED - Aciaries Reunies de Burbach-Eich-Dudelange, Luxembourg, Luxembourg

[21] Appl. No.: 743,520

[22] Filed: Nov. 19, 1976

[30] Foreign Application Priority Data

Nov. 21, 1975 Luxembourg ..... 73846

[51] Int. Cl.[2] ..... C21C 7/00

[52] U.S. Cl. ..... 266/225

[58] Field of Search ..... 266/225, 226

[56] References Cited

U.S. PATENT DOCUMENTS 3,394,928 7/1968 Wiedl ..... 266/226

*Primary Examiner*—Gerald A. Dost

*Attorney, Agent, or Firm*—Karl F. Ross; Herbert Dubno

[57] ABSTRACT

A method of removing encrustations from a metallurgical lance comprising the steps of relatively displacing the lance and a tool with the tool in contact with a layer of encrustation on the lance and applying a repetitive movement to the tool against the layer to dislodge the layer from the lance and permit the layer to fall therefrom by its weight.

22 Claims, 4 Drawing Figures

METHOD OF AND APPARATUS FOR THE DECRUSTING OF METALLURGICAL LANCES

FIELD OF THE INVENTION

The present invention relates to a method of and to an apparatus for the decrusting of metallurgical lances and, more particularly, to the removal of encrustations of slag and metal on portions of metallurgical lances of the type used for the blowing of gases and other materials into a metallurgical melt.

BACKGROUND OF THE INVENTION

In the refining of metals, e.g. the oxygen refining of steel, it has been a growing practice to inject air or oxygen below the surface of the melt or to train a jet of air or oxygen onto the melt surface, with or without entrainment of refining (e.g., deoxidizing), alloying or other reactive materials in the gas stream.

The lances may be thrust below the surface of the slag layer overlying the metal bath or may merely penetrate the slag layer to blow gas into the melt from the top.

In all of these cases, a significant problem has been recognized in the art with respect to encrustation or coating of the lance with slag and metal, either by spattering from the surface of the bath or by direct contact of the lance with the bath, the encrustations solidifying upon the lance in the form of a layer which greatly increases the weight of the lance and the difficulty of its manipulation.

Attempts have been made to remove this layer manually by torches and/or chisels and even automatically by using a scraper against which the lance is drawn by the means enabling its manipulation and return to its repose state out of the melt, ladle, converter or furnace in which the refining takes place.

Whether the technique used in manual or automatic, there are certain problems which have arisen in connection with the attempts to remove the encrusting layers from the lance. Especially when the layer contains metal it is extremely hard and frequently is relatively thick so that the force which must be used is considerable and may endanger the lance or the means for manipulating same. Other techniques involve this disadvantage and also require very long times for removal of the crusts while other techniques, including those requiring the use of torches, are time consuming and possible detrimental to the lance itself. Until now, therefore, a completely satisfactory system for removing slag and metal deposits on metallurgical lances has not been developed.

OBJECTS OF THE INVENTION

It is the principal object of the present invention to provide an improved method of decrusting metallurgical lances in which the aforementioned disadvantages are obviated.

Still another object of the invention is to provide a method of removing slag and metal deposits from metallurgical lances automatically and without detriment to the lance or its supporting or manipulating structure or mechanism.

Still another object of the invention is to provide improved apparatus for automatically removing heavy and dense slag and metal layers from metallurgical lances without applying undue stress to the lance and its supporting or manipulating structure.

It is, moreover an object of the invention to provide a method of and a device for the removal of encrustations on metallurgical lances which can effect such removal particularly rapidly and at relatively low cost.

SUMMARY OF THE INVENTION

These objects and others which will become apparent hereinafter, are attained, in accordance with the present invention, with a method in which the deposited slag and/or metal layer is detached from a metallurgical lance along one or more circumferential and/or axial strips or bands with the air of dynamic forces resulting from the combination of the movement of the lance and one or more movements of a tool juxtaposed with the lance engageable with the deposited layer, the tool being actuated with a repetitive movement designed to loosen the deposited material so that under the forces resulting from this juxtaposition of movement and the weight of the deposit, the latter is disengaged from the lance.

According to a feature of the invention the layer is detached by the percussive action of the tool during retraction of the lance along two pairs of the layer to be detached and having a breadth of at least one centimeter. Preferably the action of the tool is applied to zones of the layer separated about the circumference of the lance to loosen the layer and permit the latter to detach itself all aroung the lance and dislodge under its own weight.

The invention uses the fact that the layer is substantially cohesive and capable of being dislodged in a single piece or in several pieces once a percussion action is applied to the layer by the tool and as the tool and the lance are moved relatively. The applied forces thus include a static force which is negligible until the layer is dislodged, this force being the weight of the tool itself, the force of a spring, and a considerable dynamic force which is due essentially to the vibratory movement of the tool. However, because of the large ratio of the mass of the lance to the mass of the tool, the maximum force exerted on the lance is able to be withstood without difficulty by the winch or windlass supporting the lance.

For the decrusting of a refining lance the relative speed between the decrusting tool itself and the lance is composed in principle of a more or less constant component corresponding to the movement of the lance, for example 25 meters per minute, and a variable component whose amplitude or speed is, for example, at least ten times greater. This variable component corresponds to the back and forth movement of the decrusting tool.

In general the decrusting action is effected continuously while the lance is subjected to movement at constant speed. However, it is also possible with the scope of the process of the present invention to operate the decrusting tool when the lance is at a standstill or to advance the lance intermittently in increments of a given distance.

It is also possible within the scope of the present invention, to impact a supplemental movement to the tool which is intermittent and usually relatively slow, being effected, for example, in a plane perpendicular to the lance and parallel to the surface thereof.

An apparatus or device able to practice the method of invention, i.e. the decrusting of a lance, comprises at least one tool disposed adjacent the lance and movable relative to its support and which is actuated with at least one movement, particularly a rapid repetitive movement parallel to the surface of the lance.

Investigations have shown that the percussive actuation of this tool is capable of providing results which could not be attained with one or more saws or grinding tools designed to dislodge the layer by slitting it along, for example, a generatrix of the lance. These methods have not been found to be viable economically because the tools are rapidly worn out by the abrasive mixture of slag and metal. It is possible however, to make use of a tool with surround the lance and which intermittently impacts against the lance.

In a preferred embodiment of the invention, wherein the lance is restricted vertically from the furnace, the tool has a rectangular attack face of a breadth adapted to the diameter of the lance, for example, greater than one centimeter. The percussive movement is applied pneumatically and the tool and percussive assembly is movable relative to the lance by a parallelogrammatic linkage connecting this assembly to the support. The pressure of the tool against the lance to be decrusted is applied by a spring which at the same time exerts the maximum force upon the lance.

Thus, according to the invention, it is possible to free the lance of its layer of slag and/or metal without endangering the lance or deforming same. The vibratory movement permits the use of relative speeds of the lance and tool which are elevated, thereby eliminating the danger of jamming or blocking. The elevated pressure resulting from the engagement of the tool with the layer are created and located in the layer to be detached so that stress creating accelerations communicated to the lance are of little effect because of the large inertia of the lance as a result of the high ratio of the mass of the lance and the movable tool. The layer and the lance may have curved or irregular shapes and, if desired, the movable tool can conform thereto.

If during the vibratory movement the tool encounters an excessive resistance, it is cammed outwardly on its parallelogrammatic linkage against the force of the spring to prevent damage to the lance or other tool. Similarly the parallelogrammatic linkage allows the tool to be built closer to or further from the lance as required as the layer is of greater or lesser thickness.

The apparatus is readily accommodated at blowing stations already in use, needs little maintenance and is not of such high cost as to created problems in replacement. The materials from which it can be constructed can be of high durability.

BRIEF DESCRIPTION OF THE DRAWING

The above and other objects, features and advantages of the present invention will become more readily apparent from the following description, reference being made to the accompanying drawing in which.

SPECIAL DESCRIPTION

Figure 2:
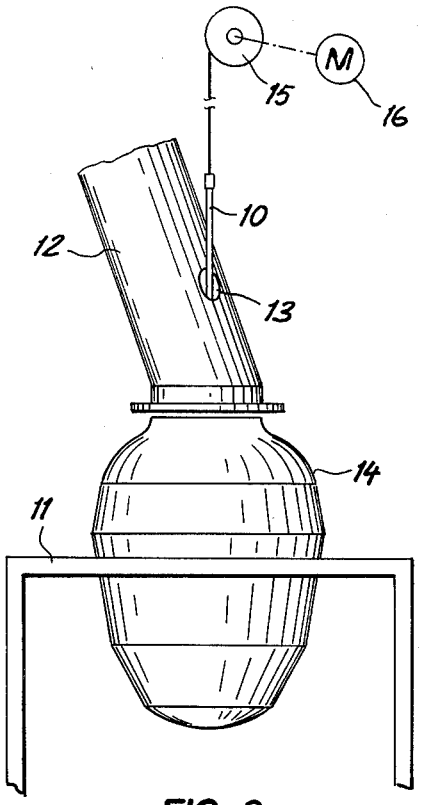
FIG. 2 is a diagrammatic elevational view showing how installation in the apparatus of FIG. 1 can be incorporated.

Referring first to FIG. 2 it can be seen that the usual oxygen refining system can comprise a furnace 14 mounted on a support 11 and disposed below a hood 12 through an opening 13 in which an oxygen blowing lance 10 can be raised and lowered. The means for vertically displacing the lance include a windlass 15 driven by a variable speed motor 16. According to the invention, within the hood 12, the lance can be decrusted, i.e., the deposits of slag and/or metal can be removed with the aid of a tool 1.

Figure 1:
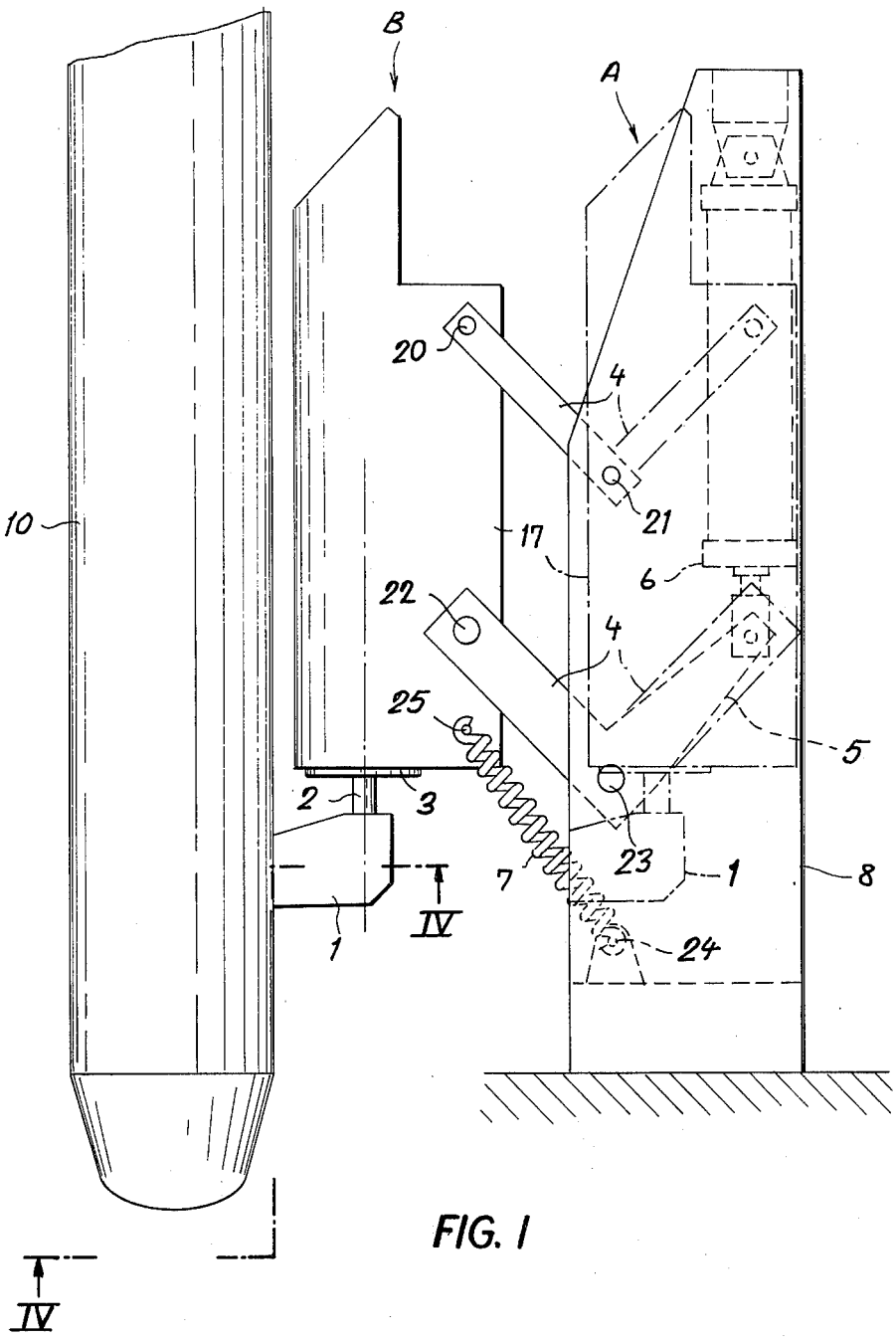
FIG. 1 is a somewhat diagrammatic vertical elevational view of a portion of an apparatus for carrying out the method of the present invention.
Figure 4:
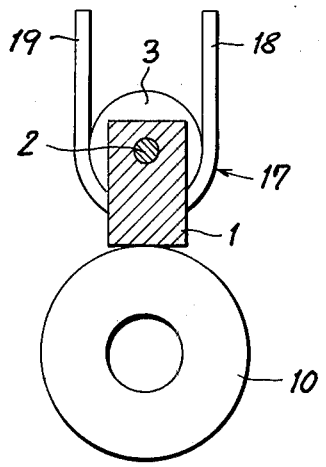
FIG. 4 is a view taken generally along the line IV—IV of FIG. 1.

More particularly, the tool 1 is formed as a vibratory head of a rectangular section (10 cm × 20 cm) connected by a rod 2 to a percussion cylinder 3 within a housing 17 movable between the inoperative position shown in dot-dash lines at A and the operative position shown in solid lines at B in FIG. 1. As can be seen in FIG. 4, the housing 17 has a pair of spaced apart flanks 18 and 19 between which the cylinder 3 is received and which can flank a cylinder 6 disposed within a support 8 open toward the lance 10. The housing 17 is carried on a parallelogrammatic linkage formed by levers 4 pivotally connected at 20 and 21 or 22, 23 to the support 8. A spring 7 is pivotally connected at 24 to the support 8 and to the housing 17, the point 25 at which the spring is attached to the housing 17 being swingable past the pivot 23 so that the spring 7 retains the housing 17 in its restricted position shown at A. However, when an actuating lever 5 is rotated in the counterclockwise sense by the pneumatic cylinder 6 within the support 8, the spring 7 swings into the position shown in solid lines in FIG. 1 and applies the head 1 with a given force to the layer of slag to be dislodged from the lance. The force contributed by the spring can be in addition to any force developed by the pneumatic cylinder 6.

Figure 3:
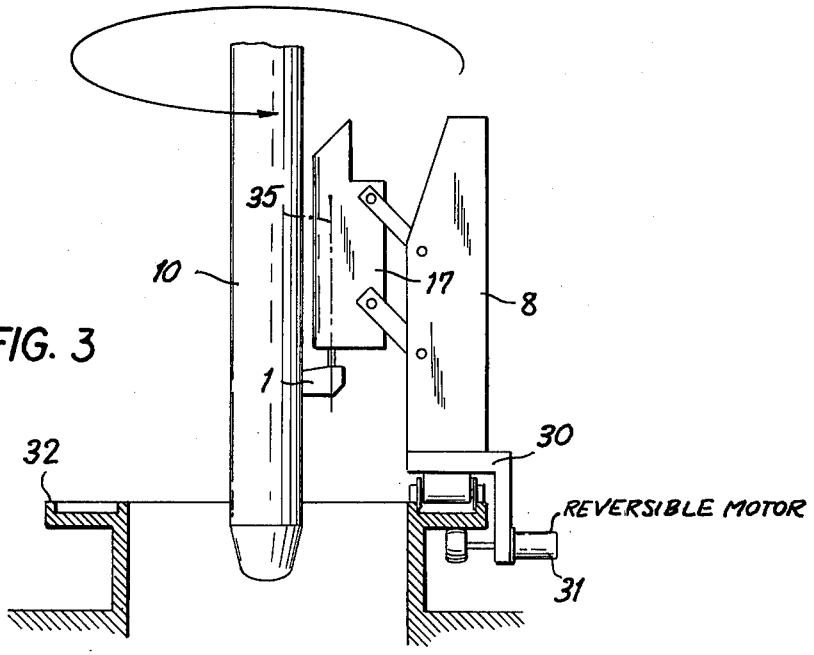
FIG. 3 is a view of an installation according to another embodiment of the invention.

The percussive cylinder 3 is preferably operated at a speed of 350 vibrations per minute while the mass of members 1, 2 and the parts within the percussion cylinder 3 can amount to, for example, 30 kg, with spring forces being about 300 kg f. The device has been found to be particularly effective in the decrusting of excessive slag on oxygen lances as described. In FIG. 3 shown in the system in which a support 8 is mounted on a carriage 30 driven by a motor 31 on a track 32 surrounding the lance 10 so that a further movement is imposed upon the tool 1, namely, a circular movement slowly around the lance or a periodically changing semicircuit movement in this case. The vibratory movement, however, is a movement of member 1 angularly about its axis 35 either continuously or semicircularly with periodic change in sense. In this case the tool 1 can be a disk provided with an abrasive surface or peripherally with cogs adapted impacing against said layer. A motor driving the disk can be contained within the housing 17 in place of the pneumatic vibrator described in connection with FIGS. 1 and 4.

We claim:

1. A method of removing encrustations from a metallurgical lance comprising the steps of:

relatively displacing the lance and a tool with the tool in contact with a layer of encrustation on said lance; and applying a repetitive movement to said tool against said layer to dislodge said layer from said lance and permit said layer to fall therefrom by its weight.

2. The method defined in claim 1 wherein said repetitive movement is a movement at a velocity of at least a multiple of the velocity of the relative movement of said lance and said tool.

3. The method defined in claim 2 wherein said repetitive movement is a vibratory movement.

4. The method defined in claim 3 wherein said repetitive movement comprises a relatively slow first compartment substantially circular and around said lance and a relatively rapid second compartment parallel to the axis of said lance.

5. The method defined in claim 3 said repetitive movement comprises a circular movement or a semicircular movement with periodic change in sense.

6. The method defined in claim 3 wherein said layer is engaged during movement of said lance by said tool along at least two bands of a breadth each of at least 1 cm.

7. The method defined in claim 3 wherein the forces resulting from said repetitive movement against said layer are greater than that due to the weight of the tool.

8. The method defined in claim 3 wherein the resultant of the forces applied to said lance during the dislodging of said layer are less than the maximum force supporting the lance.

9. The method defined in claim 2 wherein the amplitude of the speed of the repetitive movement is at least 10 times greater than the speed of movement of the lance.

10. The method defined in claim 1 wherein the lance is moved intermittently.

11. A device for the removal of a layer of crust on a metallurgical lance suspended and vertically movable by a suspension which comprises: a support, said lance being displaceable past said support, a tool mounted on said support and engageable with said layer on said lance, and means for imparting a repetitive movement to said tool in excess of the rate of displacement of said lance.

12. The device defined in claim 11 wherein said tool is supported by parallel arms articulated to said support.

13. The device defined in claim 11 further comprising a spring biasing said tool against said lance.

14. The device defined in claim 13 wherein the force of said spring is substantially less than the maximum force sustainable by the suspension for said lines.

15. The device defined in claim 12, further comprising a pneumatic cylinder fixed on said support and actuating said arms.

16. The device defined in claim 11 wherein said support is mounted on a rail surrounding said lance.

17. The device defined in claim 11 wherein said tool comprises a head engageable with said layer and a pneumatic percussion cylinder operating said head.

18. The device defined in claim 17 wherein said head is a body of substantially rectangular configuration.

19. The device defined in claim 11, further comprising a motor connected to said tool.

20. The device defined in claim 19 wherein said tool is a disk provided circumferentially with cogs engageable with said layer.

21. The device defined in claim 19 wherein said tool is a disk.

22. The device defined in claim 18 wherein said tool is constituted of an abrasive material.

* * * * *